United States Patent [19]

Marotto

[11] 4,143,699

[45] Mar. 13, 1979

[54] VENETIAN BLIND TILT LIMITER

[75] Inventor: Anthony F. Marotto, Philadelphia, Pa.

[73] Assignee: Marathon Manufacturing Company, Houston, Tex.

[21] Appl. No.: 849,094

[22] Filed: Nov. 7, 1977

[51] Int. Cl.[2] ..... E06B 9/26
[52] U.S. Cl. ..... 160/176 R
[58] Field of Search ..... 160/166–178

[56] References Cited

U.S. PATENT DOCUMENTS 2,788,066 4/1957 Toti et al. ..... 160/177

*Primary Examiner*—Peter M. Caun
*Attorney, Agent, or Firm*—Robert K. Youtie

[57] ABSTRACT

A tilt limiting mechanism for a venetian blind including a mounting member non-rotatably positioned in the blind head rail and providing a guideway partially about the tilt rod, a radial extension on the tilt rod extending into the guideway for swinging movement therealong upon tilt rod rotation, and stop members positioned in the guideway to engage the radial extension and limit rotative movement of the tilt rod.

6 Claims, 5 Drawing Figures

FIG. 1
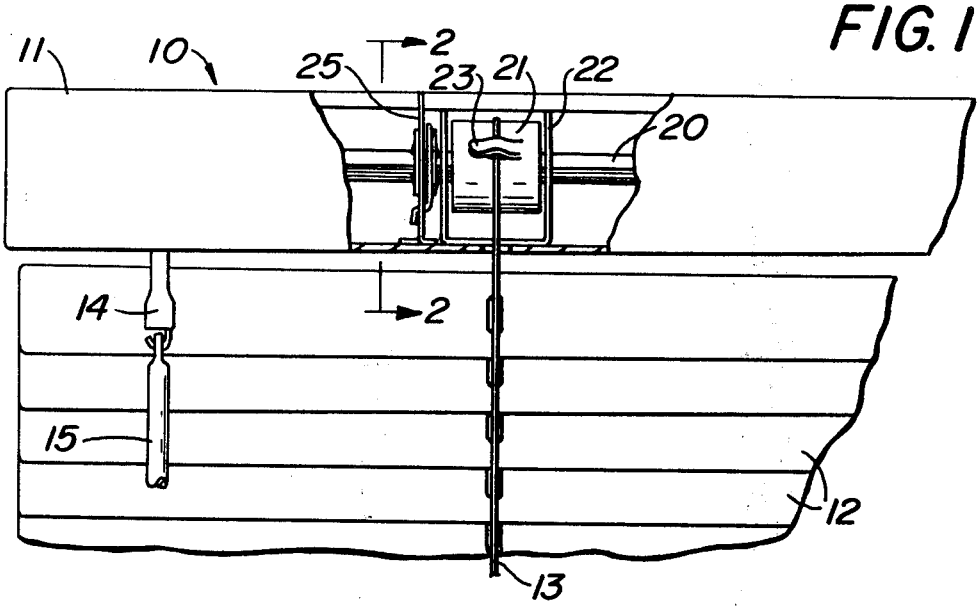
FIG. 2
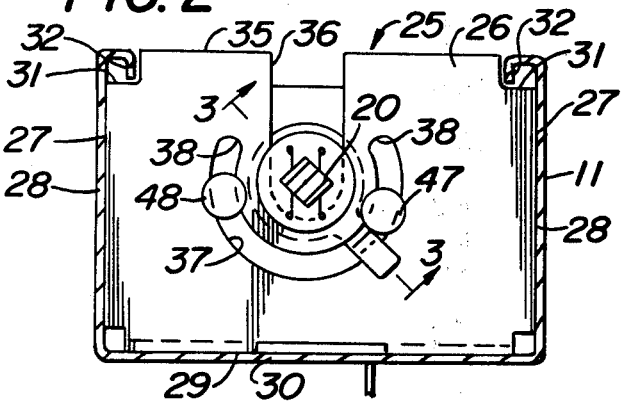
FIG. 5
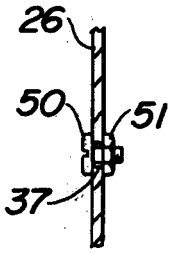
FIG. 4
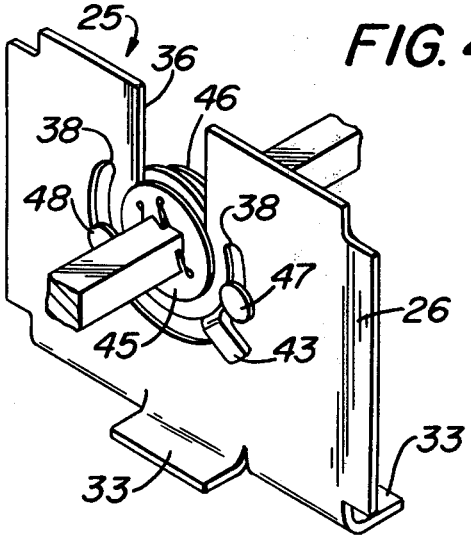
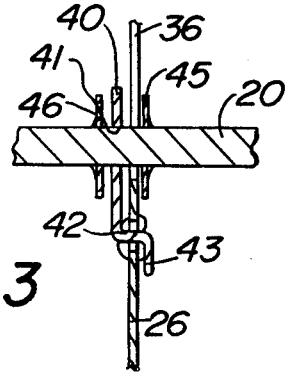
FIG. 3

VENETIAN BLIND TILT LIMITER

BACKGROUND OF THE INVENTION

As is well known to those versed in the venetian blind art, it is often desirable to limit the permissible tilt of the blind slats, as for improved appearance, energy conservation, reduction in ladder and slat wear, preventing damage to tilt operating mechanisms, and for other reasons. However, prior devices for limiting slat tilt have not satisfactorily accomplished the foregoing, and have not otherwise been satisfactory, requiring complex mechanisms subject to malfunction, increasing manufacture and assembly costs, and involving high die costs in modifications to the tilt control gearing.

SUMMARY OF THE INVENTION

Accordingly, it is an important object of the present invention to provide a tilt limit device for a venetian blind which is extremely simple in construction for great durability and reliability throughout a long useful life, being economical to manufacture and assemble in a venetian blind so as to add very little to costs, and which is positive and foolproof in operation, while being adjustable to achieve a wide variety of tilt limit settings.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 1 is a partial front elevational view showing a venetian blind constructed in accordance with the teachings of the present invention, and partly broken away to illustrate structure of the invention.

FIG. 2 is a partial transverse sectional view taken generally along the line 2—2 of FIG. 1.

FIG. 3 is a sectional view taken generally along the line 3—3 of FIG. 2.

FIG. 4 is a partial perspective view showing the structure of the instant invention, apart from the venetian blind head rail, for clear understanding thereof.

FIG. 5 is a sectional view showing a slightly modified embodiment of the present invention.

DESCRIPTION OF THE PREFERRED EMBODIMENTS

Referring now more particularly to the drawings, and specifically to FIGS. 1 and 2 thereof, a venetian blind is there generally designated 10, and may include an upwardly opening head rail or channel 11, beneath which are suspended a plurality of generally horizontally extending, superposed slats 12, as by a plurality of ladders 13. The head rail or channel 11 may have mounted therein a suitable tilt operating mechanism, say of the worm-and-wheel gear type, including an operating worm shaft 14 depending from the head rail and provided with an actuating member or operating rod 15.

As thus far described, the construction may be essentially conventional. Also conventional may be a rotatably journaled tilt rod or shaft 20 extending longitudinally within the head rail 11 and carrying ladder supports or hangers 21, to which are attached the upper ends of ladders 13. Thus, in conventional manner, there may be provided journals 22 upstanding in the head rail 11 rotatably supporting the tilt rod 20, the tilt rod carrying a ladder hanger or drum 21 nonrotatably circumposed about the tilt rod and provided with fingers or grippers 23 for releasably gripping the upper ends of ladders 13.

However, as thus far described, there is no limit to slat tilting movement, except that inherent in engagement of the slats with each other and the ladder material. As this is often undesirable, there is provided herein, in accordance with the teachings of the instant invention, a blind tilt limiter or tilt control, generally designated 25.

As best seen in FIGS. 2 and 4, the tilt limiting device includes an upright mounting member or plate 26 located extending transversely across the interior of head rail or channel 11, and being externally configured for general conforming engagement with the interior of the channel or head rail, so as to be nonrotatable with respect to the latter. More specifically, the mounting member or plate 26 is generally rectangular in outline configuration for conforming engagement within the channel or head rail. As best seen in FIG. 2, side edges 27 of the mounting member or plate 26 may extend in parallelism with each other for engagement with the upstanding front and rear walls 28 of the head rail. Also, the lower edge 29 of mounting member or plate 26 may extend generally horizontally for engagement with the lower wall or web 30 of channel or head rail 11. The upper corners of the mounting member or plate 26 may be notched or cut away, as at 31, for respectively receiving the upper side wall inturned lips 32 of the head rail 11.

Further, to resist falling of the mounting member or plate 26 toward one side or the other, there may be provided along the lower edge a plurality of oppositely outstanding extensions, flanges or feet, as at 33. These seat on the bottom wall 30 of head rail channel 11, so that the mounting member or plate is effectively maintained in its upstanding transverse relation effectively fixed with respect to the channel 11.

Extending downwardly from the upper edge 35 of the mounting member or plate 26, spaced between the side edges 27 is a cut-out or notch 36 of generally U-shaped configuration. That is, the cut-out or notch 36 extends downwardly from the upper plate edge 35 and terminates spaced above the lower plate edge flanges 33.

The notch or cut-out 36 is sized and located to spacedly receive the tilt rod 20 in the lower region of the notch.

The mounting member or plate 26 is further formed with a generally arcuate or circular slot 37 extending about the lower region of notch 36. More particularly, the arcuate slot 37 may be generally circular and of an angular extent greater than 180° terminating at opposite closed slot ends 38 on opposite sides of the notch or cut-out 36.

In addition to the mounting member or plate 26, the tilt limiting mechanism includes a rotary carrier or hub 40 which may be circumposed about the tilt rod 20, adajcent to and on one side of the mounting member or plate 26. The hub or carrier 40 is nonrotatably circumposed about the tilt rod 20, as by having a central through opening 41 of non-circular configuration for nonrotative reception therethrough of the tilt rod. The hub may extend outwardly from the tilt rod 20, where it is provided with a transverse or offsetting portion 42 passing spacedly through the slot 37 from one side of the plate 26 to the other side of the plate. From the offsetting portion 42, on the opposite side of plate 26 at hub 40, there extends a terminal portion 43, also radially outwardly away from tilt rod 20. Thus, the hub 40, its offsetting portion 42 and terminal portion 43 may be considered as a radial extension from tilt rod 20, and passess through the slot 37, so that the latter may be considered as a guideway for the radial extension, all upon rotation of tilt rod 20.

In order to limit longitudinal displacement of rod 20 and its radial extension 40, 42 and 43 with respect to the mounting member 26, there may be provided one or more retaining members, as at 45 and 46 respectively adjacent to plate 26 and hub 40. The retaining members may be of the speed nut type frictionally engaged on the tilt rod.

In order to limit slat tilting movement through a desired angle, there are provided in the guideway or slot 37 a pair of spaced stop members, as at 47 and 48. The stop members 47 and 48 may assume the configuration of rivets, or the like, extending through slot 37 and deformed into engagement with opposite faces of the plate 26, so as to be located in occluding relation with slot or guideway 37 for abutting engagement with opposite sides of radial extension 40, 42, 43. The stop members 47 and 48 may be selectively positioned to afford a desired included angle of slat tilt, as well as a desired position of the angle of slat tilt. For example, it may be desired to limit slat tilting movement between a fully opened position with slats horizontal, and a fully closed position in one direction only. Of course, the included angle of slat tilt, and the location of its extremities may be selectively predetermined by selectively locating the stop members or fasteners 47 and 48 along the slot or guideway 37. As the tilt rod 20 is rotated, the offsetting portion 42 of radial extension 40, 42, 43 will engage one or the other of stop members 47, 48 to positively limit slat tilt, without adversely affecting the slats, ladders, tilt operating mechanism, or other.

While the use of rivets 47 and 48 may be relatively permanent, or difficult to remove and change, other stop members of less permanent nature may be employed. For example, in FIG. 5 there is shown a threaded fastener 50, such as a machine screw, extending through the slot or guideway 37, and provided on the side opposite to the screwhead with an internally threaded mating fastener element or nut 51. Obviously, the fastener 50, 51 may serve as a stop member, and may be selectively positionable for adjustment of tilt, as desired.

In either case, the offsetting portion 42 of the radial extension 40, 42, 43 which extends generally longitudinally of the tilt rod 20, will abut in limiting engagement with the selected type of fastener to achieve the desired results.

From the foregoing, it is seen that the present invention provides a slat tilt limiting device for a venetian blind which is extremely simple in construction, automatic and foolproof in operation, relatively inexpensive to add but little to the cost, and otherwise fully accomplishes its intended objects.

Although the present invention has been described in some detail by way of illustration and example for purposes of clarity of understanding, it is understood that certain changes and modifications may be made within the spirit of the invention.

What is claimed is:

1. A venetian blind tilt operating mechanism comprising a head rail, a tilt rod journaled in said head rail and rotatable for tilting slats, operating means for rotating said tilt rod in opposite directions, a mounting member non-rotatably positioned in said head rail adjacent to said tilt rod, said mounting member having a guideway partially surrounding said rod, a radial extension on said rod extending into said guideway and rotatable with said rod for swinging in said guideway, and stop members positioned in said guideway for limiting engagement with said rod extension to limit tilting movement of slats, said mounting means comprising a plate extending conformably across said head and, said radial extension including a hub on one side of said plate, an offset portion extending from said hub through said guideway, and a terminal portion extending from said offset portion on the other side of said plate.

2. A venetian blind according to claim 1, in combination with a retainer on said tilt rod and engageable with one of said plate and hub to limit longitudinal shifting movement of said rod and prevent binding engagement of said radial extension with said plate.

3. A venetian blind according to claim 2, said guideway being defined by a slot, and said stop member comprising a fastener extending through said slot.

4. A venetian blind according to claim 1, said plate having a cut-out rotatably receiving said tilt rod.

5. A venetian blind according to claim 1, said guide way being defined by an arcuate slot, and said stop members comprising fasteners extending through said slot.

6. A venetian blind according to claim 1, in combination with a pair of retainers on said tilt rod on opposite sides of and respectively engagable with said plate and hub to limit longitudinal shifting movement of said rod in both directions and prevent binding engagement of said radial extension with said plate.

* * * * *